United States Patent [19]

Post

[11] Patent Number: 4,718,265

[45] Date of Patent: Jan. 12, 1988

[54] BENDING APPARATUS FOR ROD- OR RIBBON-SHAPED MATERIAL

[75] Inventor: Friedhelm Post, Bad Säckingen, Fed. Rep. of Germany

[73] Assignee: Alpha Maschinenbau Ag, Zurich, Switzerland

[21] Appl. No.: 836,305

[22] Filed: Mar. 5, 1986

[30] Foreign Application Priority Data

Mar. 12, 1985 [DE] Fed. Rep. of Germany ..... 3508809

[51] Int. Cl.[4] ..... B21D 7/02

[52] U.S. Cl. ..... 72/217; 72/218; 72/219; 72/387

[58] Field of Search ..... 72/381, 384, 387, 388, 72/212, 213, 216, 217, 218, 219, 472, 157, 158, 306, 307; 140/102, 104, 105; 29/33 F, 34 D, 40, 50

[56] References Cited

U.S. PATENT DOCUMENTS

| | | | |
|---|---|---|---|
| 2,682,698 | 7/1954 | Berthiez | 29/40 |
| 2,743,757 | 5/1956 | Terwilliger | 72/219 |
| 3,151,656 | 10/1964 | Brede | 72/157 |
| 3,894,422 | 7/1975 | Peddinghaus | 72/219 |
| 4,526,025 | 7/1985 | Ritter et al. | 72/388 |

FOREIGN PATENT DOCUMENTS

| | | | |
|---|---|---|---|
| 0123231 | 10/1984 | European Pat. Off. | 72/217 |
| 3123558 | 1/1983 | Fed. Rep. of Germany | 72/217 |
| 317206 | 12/1956 | Switzerland | 72/217 |

*Primary Examiner*—Robert L. Spruill
*Assistant Examiner*—David B. Jones
*Attorney, Agent, or Firm*—Christie, Parker & Hale

[57] ABSTRACT

The invention relates to a bending apparatus for bending a rod-shaped or ribbon-shaped material, comprising a bending station disposed in a work plane and including at least one bending core or pair of bending cores mounted for displacement perpendicular to the work plane, and at least one rotary body carrying a bending finger mounted for rotation about the bending core and for displacement perpendicular to the work plane. With known bending apparatus it is scarcely possible to vary the bending mode, or the bending radius, respectively, without time-consuming adaptation of the bending station. Such adaptation may be required several times for a single workpiece. In accordance with the invention, the bending core or pair of bending cores is mounted, together with at least one further bending core or pair of bending cores for selectively employ in a bending operation, in a turret head mounted above the work plane for rotation at least to several operating positions. This permits the bending apparatus to be rapidly readjusted during the process of one and the same workpiece.

23 Claims, 3 Drawing Figures

BENDING APPARATUS FOR ROD- OR RIBBON-SHAPED MATERIAL

DESCRIPTION

Figure 1:
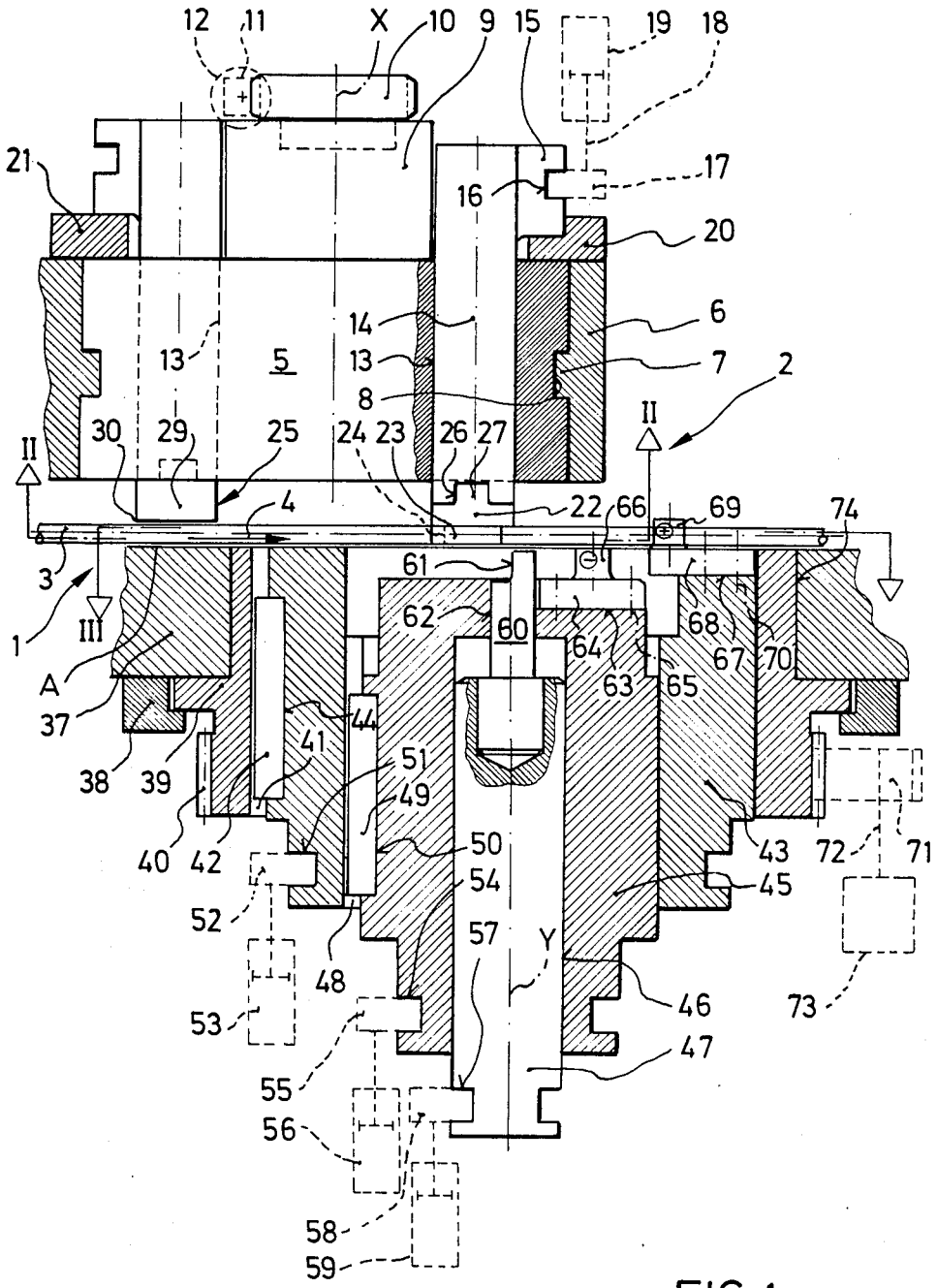

The present invention relates to a bending apparatus for bending rod-shaped or ribbon-shaped materials, comprising a bending station disposed in a work plane and including a bending core or pair of bending cores mounted for vertical displacement relative to said work plane, and at least one rotary body carrying at least one bending finger mounted for rotation about the bending core or pair of bending cores and for vertical displacement with respect to said work plane.

In a bending apparatus of this type known from EP-A No. 01 23 231, a pair of bending cores is mounted on a plunger ending below the work plane and mounted for displacement perpendicular to the work plane. The plunger is mounted in a cylindershaped element surrounded by the rotary element in which two bending fingers are mounted for displacement perpendicular to the work plane. The rotary body is rotatable about the axis of the plunger by means of a gear transmission for bending the rod-shaped material in the desired manner, while one of the two bending cores acts as a support for the material. The plunger is adapted to project beyond the work plane to a position whereas a cutting edge formed at a rim portion thereof cooperates with a counter cutting edge or cutting anvil formed by a tunnel-shaped cover member. This apparatus suffers from the disadvantage that it is scarcely possible to vary the bending mode, i.e. that the bending radius of the material around the ending cores is limited, because the diameter of the bending cores as well as the radial distance of the bending fingers from the axis of the plunger carrying the bending cores are non-variable. A changeover to other bending radii thus requires the bending cores to be exchanged, resulting in a troublesome and time-consuming operation, particularly in the case of a single workpiece which has to be bent with several different bending radii. It is also disadvantageous that the cut-off location of an already bent workpiece necessarily lies beyond the last-formed bend in the feed direction, so that the workpiece has to be retracted when it is to be cut off adjacent the last-formed bend.

It is an object of the invention to provide a bending apparatus of the type defined above permitting the bending mode to be varied over a wide range without requiring complicated adjustment or replacement operations.

The stated object is attained according to the invention by a bending apparatus having a bending station disposed in a work plane and including at least one bending core mounded for vertical displacement relative to the work plane and at least one rotary body carrying at least one bending finger mounded for rotation about the bending core and for vertical displacement with respect to the work plane, wherein the bending core is mounted with at least one other bending core for selective employment in a bending operation, in a turret head mounted above the work plane for rotation around a stationary axis of rotation into at least one operating position of a plurality of possible positions by a rotary drive means.

In a bending apparatus of this construction, a changeover to another bending radius only requires the turret head to be rotated for aligning another bending core or another pair of bending cores in the bending position.

Time-consuming tool change operations are no longer required. The relocation of the bending core or pair of bending cores to a position above the work plane in the bending station results in the further advantage that there is abundant space available for the bending fingers and associated components to thereby facilitate adjustment operations or the like permitting the bending mode to be readily varied even during the processing of one and the same workpiece.

In a bending apparatus of the kind disclosed, a high versatility is achieved. As it permits a practically unlimited number of bending cores or pairs of bending cores to be employed by releasably securing them to the inserts provided in the turret head. During operation of the apparatus with one bending core or pair of bending cores, another bending core or pair of bending cores can be replaced or serviced without having to stop the operation of the bending apparatus. As the turret head is locked against rotation in the operating position, it is capable of efficiently absorbing substantial bending forces In addition the turret head is of simple construction, as it is only responsible for the rotatable mounting of the inserts carrying the bending cores or pairs of bending cores.

In a further embodiment of the apparatus disclosed a considerable portion of 5 the work area in the bending station is freely accessible, and the material is additionally supported from above in the vicinity of the bending core or pair of bending cores.

It is further advantageous that in the apparatus disclosed a rack-and-pinion actuator permits the turret head to be rapidly and accurately rotated to the desired position without requiring too much space.

In a further structurally simple embodiment, one of the inserts being aligned in the operating position is effective to automatically lock the turret head against rotation.

The employ of an additional annular body for the bending apparatus as disclosed is advantageous, since said body carrying at least one further bending finger results in a further widening of the variation range with respect to the bending mode, i.e. the adjustment to greater and smaller bending radii without the need for complicated and time-consuming refitting operations. For different bending radii in one and the same workpiece the bending fingers can be exchanged, if need be several times, without having to remove the workpiece for this purpose. The movements of the bending fingers and bending cores or pairs of bending cores can be controlled in a simple manner by using microprocessors or similar electronic control circuitry.

A further advantageous embodiment, the bending station is provided with a cut-off device including a cutting anvil and a cutter element adapted to be extended perpendicular to the work plane. The accommodation of the cut-off device in the immediate work area between the bending core and the bending fingers is facilitated by the physical separation of the supports carrying the bending fingers from the turret head carrying the bending cores. This positioning of the cut-off device results in the positive effect that each bent section of a material can be cut off practically at any longitudinal location, that is, at any point between the respective bending core and the bending finger as well as at any longitudinal location lying therebeyond in the feed direction. In the latter case, all that is required after the bending operation is to advance the material over the desired distance in the feed direction. A retraction of the material opposite to the normal feed direction may not be required in this embodiment, resulting in a substantial simplification of the feed mechanism and its control.

It is important to have the cutter element to be actuated independently of the other components of the bending station.

In a further embodiment the cutting anvil is provided on the actually working bending core or pair of bending cores. Also advantageous is to have the cutting anvil carried by a separate insert employed only for the cut-off operation, whereby the quality of the cut is improved. The insert carrying the cutting anvil is brought to the cutting position by means of the turret head, the effortless rotatability of the turret head permitting this step to be quickly carried out after any bending operation. In this context it is also advantageous that the insert carrying the cutting anvil acts as a hold-down support or counterstop for the cutter element as the material is being cut.

A further advantageous embodiment comprising rotary actuator means for the rotary body disposed below the work plane. Although in addition to the rotary body with its bending finger this embodiment includes the annular body carrying a further bending finger, only a single rotary drive mechanism is required for both these elements, whereby the construction of the bending apparatus and its control are simplified.

For providing accurate circumferential and axial guidance for the rotary body and the annular body it is advantageous to let the sleeve body serve for the sole purpose of transmitting the rotary movement to the annular body and the rotary body, while the annular body on its part is vertically displaceable with respect to the work plane. Any occurring moments or forces are thus transmitted through large surface areas, resulting in reduced wear.

In a further embodiment of the disclosed apparatus the annular body is rotatably and axially displaceably mounted in the sleeve body, while the rotary body is mounted and guided in axially displaceable manner within said annular member for co-rotation therewith.

To avoid collisions between the respective drive mechanisms, the selective axial displacement of the rotary body or the annular body is advantageous.

The actuation of the cutter elements can likewise be carried out completely independent of the displacements of the rotary body and the annular body. Grooves in the rotary body and in the annular body per bending fingers to be adjusted in the radial direction for achieving a desired change of the bending radius. As the rotary body is coupled to the annular body for co-rotation therewith, it is obviously possible to mount only a single insert body carrying a bending finger in the two mutually aligned grooves, and to lock it in position in one or the other of the grooves or even simultaneously in booth grooves, so that the bending finger may assume an intermediate position between the rotary body and the annular body. A shifting of the point of engagement of the bending finger relative to the bending core or pair of bending cores may be achieved by solely rotating the insert body by an angle of 180°. This readjustment can be carried out in the shortest possible time.

Finally the shoulder, which may also extend along the full periphery, permits the selective displacement of the rotary body or the annular body together with the bending finger carried thereby even when the insert body secured in the groove of the rotary body or in that of the annular body extends radially beyond the gap between the rotary body and the annular body into engagement with the respective other groove. This arrangement permits for instance the annular body carrying the respective insert body with its bending finger to remain below the work plane while the rotary body carrying a further insert with another bending finger at a radially inner position is displaced towards the work plane for bringing the last-mentioned bending finger to the operating position.

Figure 2:
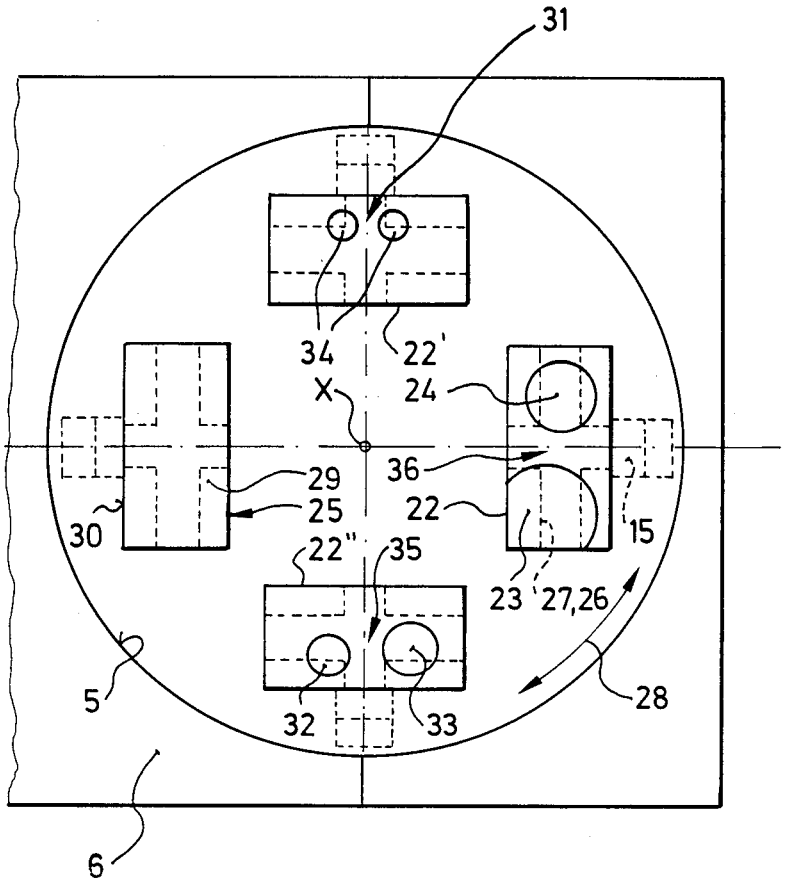
Figure 3:
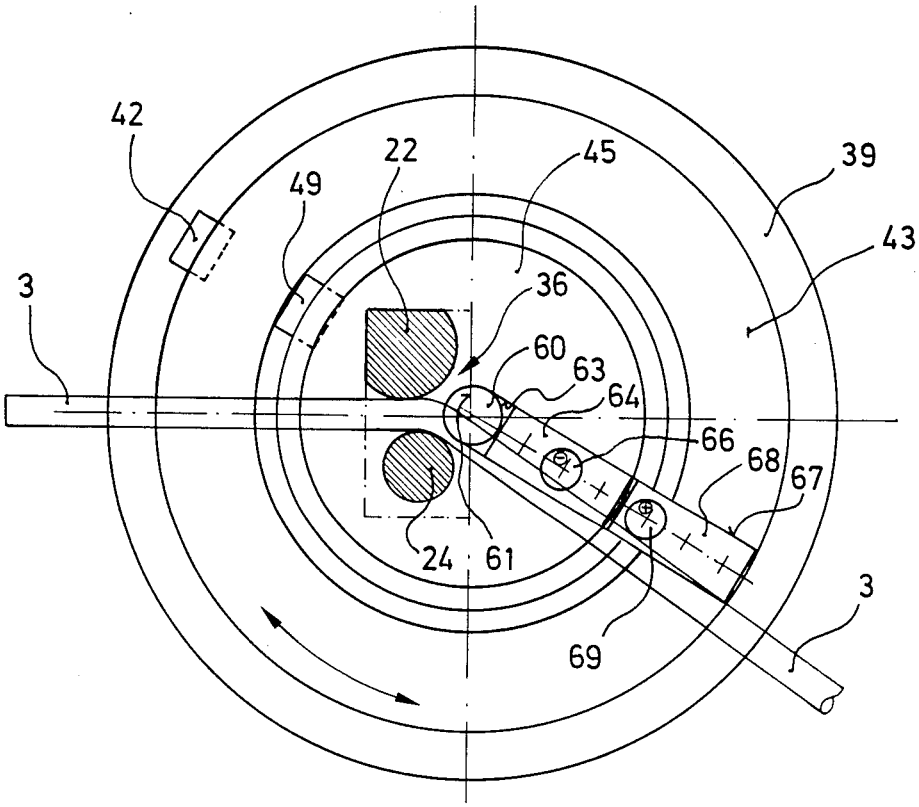

A preferred embodiment of the subject matter of the invention shall now be described by way of example with reference to the accompanying drawings, wherein:

FIG. 1 shows a vertical section through the bending station of a bending apparatus, FIG. 2 shows a bottom plan view of a detail from FIG. 1 in the plane II—II, and FIG. 3 shows a top plan view of a further detail of the bending apparatus of FIG. 1 in the plane III—III.

In a bending apparatus 1, of which FIG. 1 shows essentially only a bending station 2, there is provided a work plane A across which a rod-shaped or ribbon shaped material 3 is linearly advanced in the direction of an arrow 4 under the control of a feed mechanism (not shown). In bending station 2, material 3 is formed with bends, the shape, orientation and number of which is determined by a not shown control apparatus. The bends may be formed in succession either by stopping the advance of the material or during continuous advance of the material with a constant or variable speed. After the bending operation, workpieces each having one or more bends formed therein may be cut off from the theoretically endless material 3 for subsequent collection.

Mounted above work plane A for rotation about an axis X extending perpendicular to work plane A in bending station 2 is a turret head 5 carried in a support 6 and locked therein against axial displacement in the direction of axis X by a shoulder 7 received in a circumferentially extending groove 8. Support 6 is mounted in a not shown manner in a not shown frame of the bending apparatus or thereabove. At a centered position of its top surface turret head 5 carries an extension 9 to which a gear 10 is secured in the present embodiment. Gear 10 meshes with a diagrammatically indicated toothed rack 11 operatively connected to an actuator 12, for instance a hydraulic or pneumatic actuator cylinder 12. The actuator cylinder 12 could also be replaced by an electric actuator, for instance a linear motor. Instead of the actuating mechanism consisting of rack 11 and actuator 12 it would also be possible to provide a step motor or servo motor acting directly on gear 10 or on turret head 5. In the embodiment shown, turret head 5 is formed at circumferentially spaced locations with four vertically extending guide passages 13 of rectangular cross-sectional shape each containing a bar-shaped insert 14 mounted therein for displacement perpendicular to work plane A. The upper end portion of each insert 14 projecting from the respective guide passage 13 carries a radially outwards facing projection 15 formed with an outwards opening groove 16 for the engagement of an actuator element 17 carried by a piston rod 18 of an actuator mechanism 19, for instance an actuator cylinder. Secured to the upper end face of support 6 is an annular member 21 formed at a circumferential location with a recess 20 adapted to be engaged by the projection 15 of a respective insert 14 so as to lock turret head 5 against rotation when insert 14 is lowered to a position in which its lower end is in proximity to work plane A, so that a pair of bending cores 36 carried thereby and consisting of two bending cores 23 and 24 of different circumferential curvature, i.e. of different diameters, is in its operating position with respect to work plane A. Bending cores 23, 24 are carried by a plug member 22 formed with crosswise extending ribs 26 for locking engagement with complementary grooves 27 of insert 14, and is secured to insert 14 by threaded fasteners (not shown).

Each of the four inserts 14 carries a plug member 22, 22', 22" and 25, plug members 22, 22' and 22" being provided with different pairs 31, 35 and 36 of bending members, while plug member 25 is formed as a cutting anvil 29 having a cutting edge 30.

Bending core pair 36 consists of a bending core 24 having a smaller diameter and a bending core 23 having a larger diameter, the two cores being spaced from one another by a distance approximately corresponding to the thickness of material 3. The axis of bending core 23 is located closer to the axis of turret head 5 than the axis of bending core 24. Bending core pair 31 consists of two bending cores 34 having identical, relatively small diameters. Bending core pair 35 consists of two relatively small bending cores 32 and 33 of different diameters and circular cross-sectional shape. Plug member 22 is of rectangular shape and has a flat bottom face. It may optionally be formed with a recessed channel extending in a radial direction with respect to axis X of rotation and corresponding in shape to the cross-sectional shape of material 3 for securely supporting the material as it is being cut off. Turret head 5 is rotatable in the direction of double arrow 28 (FIG. 2) for aligning a selected one of inserts 14 in a bending or cut-off position in which its projection 15 is received in recess 20.

Work plane A is defined by the top surface of a table plate 37 formed with a circular opening 74 the axis Y of which is located downstream of the axis of rotation X of turret head 5 in the feed direction 4 of material 3.

Secured to the lower face of table plate 37 below opening 74 is an annular retainer 38 for rotatably supporting a sleeve body 39 in opening 74. The outer peripheral face of sleeve body 39 is formed with an array of gear teeth 40, while its inner peripheral wall surface is provided with a vertical groove 41 acting as a guide for a vertically displaceable key member 42 retained in a groove 44 of an annular body 43 mounted within sleeve body 39 for vertical displacement relative thereto Mounted for vertical displacement within annular body 43 is a rotary body 45 of extended length with a centrally located bore 46 forming a guide for a vertically displaceable plunger 47. The interior wall surface of annular body 43 is formed with a vertical groove 48 acting as a guide for a key member 49 retained in a groove 50 in the outer peripheral face of rotary body 45. The lower end portion of annular 43 is formed with an outwards facing circumferential groove 51 for engagement by an actuator element 52 coupled to an actuator mechanism 53. Rotary body 45 has its lower end portion likewise formed with an outwards facing circumferential groove 54 for engagement by an actuator element 55 operatively connected to an actuator mechanism 56. In the same manner the lower end portion of plunger 47 is provided with a circumferential groove 57 for engagement by an actuator element 58 coupled to an actuator mechanism 59.

Secured to the top end of plunger 47 is a cutter element 60 adapted to be extended upwards through a bore 62 of rotary body 45 and forming a cutting edge 61 for cooperation with cutting anvil 30 of plug member 25 when the respective 14 insert 14 is in the cutt-off position Rotary body 45 and annular body 43 are each formed with at least one radial groove 63 and 67, respectively, in their top surface adjacent work plane A (FIG. 3). Although in the embodiment shown each body is provided with only one such groove, there may be a plurality of such grooves at spaced circumferential locations. Grooves 63 and 67 have identical width and depth and are aligned with one another. Secured in groove 63 by means of diagrammatically indicated fixing screws 65 is an insert member 64 carrying an upwards projecting bending finger 66 at an intermediate location of its length. Groove 67 likewise contains an insert member 68 carrying a bending finger 69 at a longitudinally off-center position and secured within groove 67 by diagrammatically indicated fixing screws 70. Below groove 63 the outer wall surface of rotary body 45 is formed with a recessed shoulder of a height corresponding at least to the vertical displacement stroke of the rotary body so as to permit rotary body 45 with its bending finger 66 to be smoothly displaced even when insert member 68 partially projects into groove 63.

Gear teeth 40 of sleeve body 39 mesh with a pinion 71 carried by a shaft 72 of a rotary drive source 73, for instance an electric motor It is also contemplated to provide a toothed rack for engagement with gear teeth 40.

The bending apparatus operates as follows:

In the state shown in FIGS. 1, 2 and 3, bending core pair 36 is in the operating position Its bending cores 24 and 23 have been lowered by the action of actuator mechanism 19 to a position immediately adjacent work plane A. Projection 15 has been received in recess 20 to lock turret head 5 against further rotation. Cutter element 60 has been retracted to a position below work plane A by the action of actuator mechanism 59. Rotary body 45 has likewise been lowered by the action of actuator mechanism 56 to a position in which the top end of bending finger 66 lies below work plane A. Annular body 43 on the other hand has been raised by the action of actuator mechanism 53 so that its top surface is aligned in work plane A and its bending finger 69 projects upwards above the work plane. Material 3 has been advanced to a position in which it passes between bending cores 23 and 24 and extends to a point beyond bending finger 69. As shown in FIG. 3, annular body 43 has then been rotated by a certain angle in the clockwise direction, whereby the workpiece has been bent around bending core 24 by an angle of about 30° with a bending radius corresponding to the radius of the circumferential surface of bending core 24. If the material is to be bent further, annular body 43 is rotated further in the same direction. If further bending is not required, however, actuator mechanism 19 is activated for retracting insert 14 upwards until projection 15 is disengaged from recess 20. Subsequently turret head 5 may be rotated by an angle of 180° for aligning cutting anvil 30 with cutter element 60. In this position the insert carrying plug member 25 is lowered until the bottom face of plug memebr 25 rests on the workpiece, whereupon actuator mechanism 59 is activated for raising cutter element 60 so that the workpiece is cut off. If the workpiece is to be cut off rearwards of the last bent portion, the workpiece is previously advanced by the required distance relative to the cutting edges 61 and 30.

In an alternative manner of carrying out the bending operation, bending finger 69 may be retained in the position shown in FIG. 3, so that the advance movement of the workpiece causes the latter to be bent to a spiral-shaped or uniformly bent configuration.

If the workpiece is not to be cut off after a previous bending operation, if for instance it is to be bent again in the opposite direction, actuator mechanism 56 is activated to retract bending finger 69 to a position below work plane A. The workpiece is then further advanced in the direction of arrow 4, before actuator mechanism 53 is again operated for raising bending finger 69 to a position above work plane A, whereupon annular body 43 is rotated in the counterclockwise direction until bending finger 69 comes again into engagement with the workpiece for bending it in the opposite direction to a configuration corresponding to the shape of the other bending core 23. For selecting a smaller bending radius for this bending operation, insert 14 may be retracted upwards, and turret head 5 rotated to another bending position whereat for instance bending core pair 31 with its smaller bending cores 34 straddles the workpiece from above. For the bending operation with a smaller bending radius it may also be advantageous to raise bending finger 66 to its operating position while bending finger 69 preferably remains retracted to a position below work plane A.

As an alternative to the embodiment described above, it is also contemplated to provide separate rotary drive means for rotary body 45 and annular body 43 so as to permit bending fingers 66 and 69 to be angularly displaced independently of each other. In this manner, bending finger 66 may be employed as a counterstop for the workpiece, while bending finger 69 acts to bend the workpiece around bending finger 66 acting as a further bending core. Rotary body 45 and annular body 43 may also be provided with a number of bending fingers at circumferentially spaced locations. These bending fingers may be of different cross-sectional shapes and could be brought to the desired bending position by a corresponding rotary movement. It is further contemplated to mount rotary body 45 and annular body 43 at a fixed level with respect to work plane A, and to raise and lower only the bending fingers. The cut-off operation might also be carried out by using the outwards facing edge of each plug member 22, 22', 22'' which is anyhow aligned with cutting edge 61. This would eliminate the need for plug member 25 to be rotated to the cutting position for the cut-off operation.

I claim:

1. A bending apparatus for bending rod-shaped or ribbon-shaped materials, comprising a bending station disposed in a work plane and including at least one bending core mounted for vertical displacement relative to said work plane, and at least one rotary body carrying at least one bending finger mounted for rotation about said bending core and for vertical displacement with respect to said work plane, characterized in that said bending core is mounted together with at least one further bending core for selective employment in a bending operation, in a turret head (5) mounted above said work plane for rotation around a stationary axis (X) of rotation into at least one operating position of a plurality of possible positions, and that said turret head (5) is operatively connected to a rotary drive means.

2. A bending apparatus according to claim 1, characterized in that each bending core is releaseably secured to an insert (14) mounted in said turret head (5) for vertical displacement with respect to said work plane (A) between a lower operating position and an upper inoperative position, and that said turret head (5) is adapted to be locked against rotation in the operating position of any insert (14).

3. A bending apparatus according to claim 2, characterized in that said turret head (5) is mounted for rotation in a stationary support (6).

4. A bending apparatus according to claim 2, characterized in that each insert (14) has a lateral projection (15) adapted to be engaged by a displacement actuator means (17, 18, 19), and in the respective operating position to be received in a detent (20) of said support (6) for locking said turret head (5).

5. A bending apparatus according to claim 2, characterized in that the axis of rotation (X) of said turret head (5) extends perpendicular to said work plane (A) at an off set position up-stream of the axis of rotation (Y) of said rotary body (45) in the material feed direction (4).

6. A bending apparatus according to claim 1, characterized in that the axis of rotation (X) of said turret head (5) extends perpendicular to said work plane (A) at an offset position upstream of an axis of rotation (Y) of said rotary body (45) in the material feed direction (4).

7. A bending apparatus according to claim 1, characterized in that said rotary drive means comprises a pinion (10) on said turret head (5), a rack (11) engaging with said pinion and being guided for linear motion, and an actuator-cylinder (12) as a drive means for said rack (11).

8. A bending apparatus according to claim 1, characterized in that said rotary body (45) is surrounded by a concentric rotatable annular body (43) carrying at least one further bending finger (69), and that said rotary body (45) and said annular body (43) are mounted for selective vertical displacement with respect to said work plane until one or the other of said bending fingers (69, 66) projects above said work plane (A) for cooperation with such a bending core .

9. A bending apparatus according to claim 1, wherein there is provided at said bending station a cutoff device including a cutting anvil and a cutter element adapted to be extended perpendicular to said work plane, characterized in that said cutting anvil (30) is mounted in said turret head (5), and said cutter element (60) is disposed on the axis of rotation (Y) of said rotary body (45) in immediate proximity to said bending core.

10. A bending apparatus according to claim 9, characterized in that said cutter element (60) is mounted in said rotary body (45) in a manner permitting it to be extended therefrom through said work plane (A).

11. A bending apparatus according to claim 9, characterized in that said cutting anvil (30) is secured to at least one of said inserts (14).

12. A bending apparatus according to claim 9, characterized in that said cutting anvil (30) is secured to a cutting anvil mounting member (25) itself secured, preferably in a releasable manner, to an insert (14) in said turret head (5) and adapted to be rotated with said turret head (5) to a cutting position.

13. A bending apparatus according to claim 9, characterized in that an actuating end portion (47, 57) of said cutter element (60) projects dowwards beyond said rotary body (45).

14. A bending apparatus according to any of claims 1 to 21, 22, or 23 comprising rotary drive means for said rotary body disposed below said work plane, characterized in that said rotary body (45) is coupled to said annular body (43) for co-rotation therewith, and that said rotary drive means (71, 72, 73) acts on said annular body (43).

15. A bending apparatus according to claim 14, characterized in that a bottom portion of said rotary body (45) projects below said annular body (43), the lower end portions of said rotary body (45) and said annular body (43) being provided respectively with a circumferentially extending shoulder (54, 51) for the engagement of axial displacement actuator means (53, 56).

16. A bending apparatus according to claim 14, characterized in that said rotary drive means (71, 72, 73) acts on said annular body (43) through a sleeve body (39) coupled to said annular body (43) for co-rotation therewith.

17. A bending apparatus according to claim 16, characterized in that said sleeve body (39) is rotatably mounted at an axially fixed position below said work plane (A) and forms a bearing for the axially displaceable annular body (43) itself forming a bearing for said rotary body (45).

18. A bending apparatus according to claim 16, characterized in that the top surface of said rotary body (45) and said annular body (43) is provided respectively with at least one radial groove (63, 67) opening into said work plane (A) and adapted to have an insert (64, 68) carrying a bending finger (66,69) mounted therein for radial adjustment and fixation at different positions.

19. A bending apparatus according to claim 17, characterized in that said insert (64, 68) is of symmetric or asymmetric configuration with respect to the axis of said bending finger (66, 69).

20. A bending apparatus according to claim 18, characterized in that at least in proximity to said grooves (63, 67) the outer edge portion of said rotary body (45) and/or the upper inner edge portion of said annular body (43) is formed with a shoulder the height of which corresponds at least to the displacement stroke of said rotary body (45) or said annular body (43), respectively.

21. A bending apparatus acording to claim 1 characterized in that a means for mounting such a bending core in a turret comprises means for mounting a pair of bending cores in the turret for selective employment for bending rod-shaped or ribbon-shaped material in a clockwise direction or a counterclockwise direction, respectively.

22. A bending apparatus according to claim 21 characterized that such a pair of bending cores have different radii of curvature for forming bends of different radii.

23. A bending apparatus according to any of claims 21 or 22, characterized in that said bending cores (23, 24; 34; 32, 33) of a bending core pair (31, 35, 36) are spaced from one another by a distance approximately corresponding to the thickness of the material to be bent.

* * * * *